United States Patent [19]

Ohta et al.

[11] Patent Number: 4,668,577

[45] Date of Patent: May 26, 1987

[54] POLYETHYLENE FILAMENTS AND THEIR PRODUCTION

[75] Inventors: Toshihiko Ohta; Fujio Okada, both of Shiga, Japan

[73] Assignee: Toyo Boseki Kabushiki Kaisha, Japan

[21] Appl. No.: 821,526

[22] Filed: Jan. 24, 1986

Related U.S. Application Data

[63] Continuation of Ser. No. 648,553, Sep. 10, 1984, abandoned.

[30] Foreign Application Priority Data

Sep. 9, 1983 [JP] Japan ..... 58-167170

[51] Int. Cl.[4] ..... D02J 1/22; D02J 1/00

[52] U.S. Cl. ..... 428/364; 264/22; 264/290.5; 428/357

[58] Field of Search ..... 428/364, 394; 264/289, 264/22, 290, 290.5; 204/159.2, 157.15; 526/348.1, 352

[56] References Cited

U.S. PATENT DOCUMENTS 3,886,056 5/1975 Kitamaru et al. ..... 204/159.2

4,563,392 1/1986 Harpell et al. ..... 428/394

*Primary Examiner*—Paul J. Thibodeau

*Attorney, Agent, or Firm*—Jones, Tullar & Cooper

[57] ABSTRACT

Crosslinked polyethylene filaments made of polyethylene having an average molecular weight of not less than $4\times10^5$, which are stretched and crosslinked by irradiation of radioactive rays and have a strength of not less than 20 g/d and an initial modulus of not less than 400 g/d.

2 Claims, 1 Drawing Figure

FIG. I.
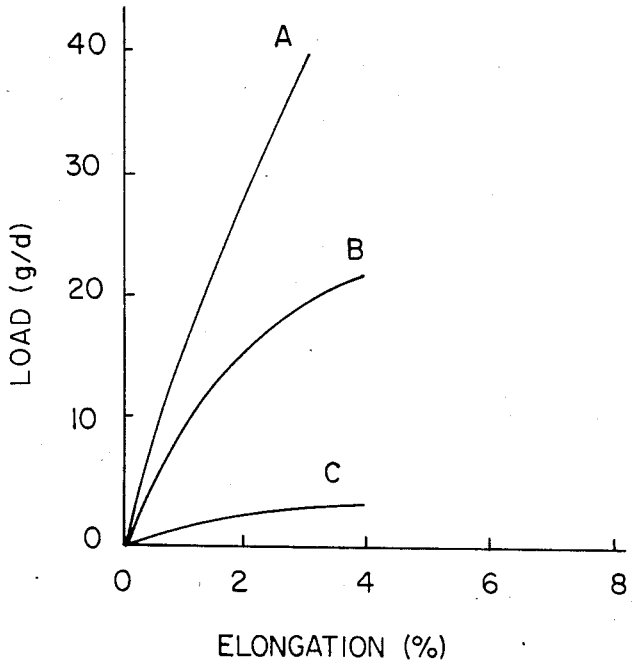

POLYETHYLENE FILAMENTS AND THEIR PRODUCTION

This is a continuation of co-pending application Ser. No. 648,553 filed on Sept. 10, 1984, now abandoned.

BACKGROUND OF THE INVENTION

The present invention relates to polyethylene filaments and their production. More particularly, it relates to polyethylene filaments having high strength and modulus with excellent heat resistance and size stability, and their production.

Polyethylene filaments have various advantageous properties and are useful as industrial materials. Namely, they are of light weight, good strength, excellent resistance to chemicals such as acid and alkali and low cost. However, their heat resistance and size stability are not sufficient. Further, enhancement of strength and modulus is desired for expanding the area of their use.

Hitherto, it is known to subject polyethylene filaments obtained by melt spinning to irradiation with radioactive rays for crosslinking. It is also known to subject the polyethylene filaments to graft polymerization with acrylic acid thereon under irradiation with radioactive rays. These procedures are said to be effective in improvement of heat resistance. However, the improvement of heat resistance by those procedures is not sufficient. Further, any material increase in strength is not produced by the procedures.

SUMMARY OF THE INVENTION

As a result of the extensive study, it has now been found that irradiation of polyethylene filaments with radioactive rays for crosslinking, said polyethylene filaments being prepared by spinning polyethylene of high molecular weight and stretching the resultant filaments, can afford filaments of high strength and modulus with excellent heat resistance and size stability.

Accordingly, the main object of this invention is to provide uncoated stretched filaments of crosslinked polyethylene of high strength and modulus with excellent heat resistance and size stability.

The stretched filaments of the invention having the advantageous properties may be prepared by irradiating radioactive rays onto stretched polyethylene filaments, obtained by spinning polyethylene of high molecular weight and stretching the resultant filaments.

BRIEF DESCRIPTION OF THE DRAWING

The FIGURE is a load-elongation curve with the abcissa representing elongation (%) and the ordinate representing load (g/d) for various polyethylene filaments.

DETAILED DESCRIPTION INCLUDING EXAMPLES

The polyethylene to be used in this invention may be linear polyethylene having an average molecular weight of not less than $4\times10^5$, preferably of not less than $1\times10^6$. Since polyethylene of $4\times10^5$ or more in average molecular weight has an extremely high melt viscosity, it is almost impossible to spin such polyethylene by a conventional melt spinning procedure. In order to achieve the successful spinning with such polyethylene, the so-called "gel spinning procedure" as disclosed in Japanese Patent Publn. (unexamined) Nos. 107,506/80 and 5228/83 is preferably adopted, although the spinning procedure is not limited thereto.

According to the gel spinning procedure, a solution of polyethylene having a high molecular weight as above defined in a solvent is spun to make filaments in a solution state. The solution state filaments are cooled to make gel-like filaments containing the solvent. After or while evaporation of the solvent, the gel-like filaments are stretched with a stretch ratio of not less than 10, preferably of not less than 20. The thus stretched filaments have usually a tensile strength of not less than 20 g/d, particularly of not less than 30 g/d, and an initial modulus of not less than 400 g/d, particularly of not less than 1,000 g/d.

The stretched filaments as above obtained are then subjected to irradiation with radioactive rays. As the radioactive rays, there may be used electron rays from an accelerator, ionizing rays such as gamma rays or X rays, etc. Dose rate, irradiation temperature and irradiation amount may be appropriately controlled so as to achieve the desired crosslinking without deterioration such as discharge break. Said appropriate control can be readily made by those skilled in the art according to the trial-and-error method taking into consideration the characteristics of the stretched filaments such as the molecular weight of polyethylene, the presence or absence of the bond of any different kind, the inclusion or non-inclusion of any additive, the state ot crystallization, the form of the filaments, etc.

For preventing the discharge breakage or promoting the crosslinking on the irradiation, any additive having such effect may be used. As an example of such additive, there are known dipropargyl maleate and other anti-aging agents as disclosed in Japanese Patent Publn. No. 31257/77. The use of such additive is usually effected by incorporating the same into polyethylene or its solution. Incorporation of the additive may be also effected after spinning, for instance, by impregnating the additive into the filaments.

The thus obtained crosslinked filaments have high strength and modulus with excellent heat resistance and size stability. Because of such advantageous properties, the filaments can be used in various fields, particularly as a reinforcing material. Conventional polyethylene or crosslinked polyethylene filaments can not be satisfactorily employed for such use.

In this invention, the particularly high average molecular weight of polyethylene might have contributed in increase of the crosslinking effect by irradiation with radioactive rays.

Practical and presently preferred embodiments of this invention are shown in the examples as set forth below. In these examples, the physical constants are determined in the following manner:

Strength:

Determined according to the constant rate elongation method as described in JIS (Japan Industrial Standard) L 1013 (1981);

Initial modulus:

Determined according to the initial tensile resistance measruing method as described in JIS L1013 (1981);

Tensile strength and tensile elongation at 100° C.:

Determined according to the constant rate method as described in JIS 1013 (1981) at a temperature of 100° C.;

Residual elongation:

Using a constant rate elongation tensile tester, a specimen clipped with a distance of 20 cm was elongated with an elongation rate of 1% per minute to reach a load of 1.5 g/d and immediately returned to the original distance with the same elongation rate as above. This operation was continued repeatedly. From the automatic recording chart, the residual elongation was read off. This reading off was carried out according to the method as described in JIS L 1013;

Average molecular weight (Mv):

The viscosity of a solution of a specimen in decalin was measured at 135° C. according to ASTM (American Standard for Testing and Materials) D2857 to determine the intrinsic viscosity [η], which was introduced into the following formula to calculate the average molecular weight:

$$Mv = 3.64 \times 10^4 \times [\eta]^{1.39}$$

EXAMPLE 1

A decalin solution of polyethylene (average molecular weight (Mv), $2 \times 10^6$) in a concentration of 2% by weight was extruded at 130° C. into the air through a spinneret, and the filaments as solified in the state of containing decalin were taken up with a take-up rate of 5 m/min. The taken up filaments were stretched in contact with a hot plate of 70° C. at a stretch ratio of 6.5 and in contact with a hot plate of 130° C. at a stretch ratio of 6.0 to make stretched filaments of 330 denier/72 filaments (density, 0.985 g/cm$^3$).

Then, electron rays from an accelerator were irradiated onto the stretched filaments in an amount of 10 Mrad for crosslinking. The acceleration energy was 1.5 MeV, and the dose rate was 0.2 Mrad/sec. The properties of the stretched filaments before and after crosslinking are shown in Table 1.

COMPARATIVE EXAMPLE 1

Polyethylene filaments (average molecular weight of polyethylene, $9 \times 10^4$; 330 denier; density, 0.952 g/cm$^3$; strength, 8 g/d; elongation, 6%; modulus, 50 g/d) prepared by melt spinning of polyethylene was subjected to irradiation with radioactive rays for crosslinking as shown in Example 1.

The properties of the stretched filaments before and after crosslinking are shown in Table 1.

EXAMPLE 2

A liquid paraffin solution of polyethylene (average molecular weight (Mv), $1 \times 10^6$) in a concentration of 3% by weight was extruded at 150° C. into the air through a spinneret, and the filaments as solified in the state of containing decalin were taken up with a take-up rate of 8 m/min. The taken up filaments were washed with methanol and stretched at a stretch ratio of 31 through a heating air tank of 150° C. to make stretched filaments of 75 denier/15 filaments.

Then, electron rays from an accelerator were irradiated onto the stretched filaments in an amount of 8 Mrad for crosslinking. The properties of the stretched filaments before and after crosslinking are shown in Table 1.

TABLE 1

| | Crosslinked filaments in Example 1 | Crosslinked filaments in Example 2 | Filaments before crosslinking in Example 1 | Crosslinked filaments in Comparative Example 1 |
|---|---|---|---|---|
| At 20° C. | | | | |
| Strength (g/d) | 40 | 37 | 38 | 8 |
| Elongation (%) | 3 | 3 | 5 | 4 |
| Modulus (g/d) | 1,500 | 1,200 | 1,300 | 70 |
| At 100° C. | | | | |
| Strength (g/d) | 38 | 35 | 22 | 3 |
| Remaining elongation at 20° C. | | | | |
| 1st (%) | 0.15 | 0.16 | 0.26 | Measurement impossible due to breakage |
| 2nd (%) | 0.16 | 0.17 | 0.28 | |
| 3rd (%) | 0.16 | 0.17 | 0.30 | |
| 4th (%) | 0.16 | 0.17 | 0.31 | |
| 5th (%) | 0.16 | 0.17 | 0.32 | |

As understood from Table 1, the crosslinked filaments of the invention (cf. Examples 1 and 2) show high strength and modulus. It is especially notable that the strength at 100° C. is almost unchanged from that at 20° C. Thus, its heat resistance at a high temperature is remarkably excellent. Conventional crosslinked filaments (cf. Comparative Example 1) are low in strength and modulus. It is notable that the strength at 100° C. is not more than ½ that at 20° C. The improvement of heat resistance is much more remarkable in the invention.

Still, the FIGURE of the accompanying drawing shows a load-elongation curve when tensile strength and elongation are measured at 100° C. The abscissa axis indicates elongation (%), while that of ordinate indicates load (g/d). In FIG. 1, (A) is crosslinked polyethylene filaments in Example 1, (B) is polyethylene filaments before crosslinking in Example 1 and (C) is crosslinked polyethylene filaments in Comparative Example 1.

What is claimed is:

1. Crosslinked polyethylene filaments made of uncoated polyethylene which is stretched and subsequently crosslinked by irradiation of radioactive rays, said uncoated, stretched and crosslinked filaments having an average molecular weight of not less than $4 \times 10^5$, a tensile strength of not less than 20 g/d and an initial modulus of not less than 400 g/d.

2. A method of producing uncoated, crosslinked polyethylene filaments having high strength, high modulus, excellent heat resistance and size stability, comprising the steps of:

stretching uncoated polyethylene filaments; and irradiating the stretched uncoated polyethylene filaments with radioactive rays such that said stretched and irradiated filaments have an average molecular weight of not less than $4 \times 10^5$, a textile strength of not less than 20 g/d and an initial modulus of not less than 400 g/d.

* * * * *